US012435938B2

(12) United States Patent
Niswander et al.

(10) Patent No.: US 12,435,938 B2
(45) **Date of Patent: *Oct. 7, 2025**

(54) TRIGGER SAFETY WITH ROTATABLE LEVER

(71) Applicant: Agency Arms, LLC, Caldwell, ID (US)

(72) Inventors: Randy Niswander, Oxnard, CA (US); Michael Parks, Canyon Country, CA (US)

(73) Assignee: AGENCY ARMS, LLC, Ventura, CA (US)

( * ) Notice: Subject to any disclaimer, the term of this patent is extended or adjusted under 35 U.S.C. 154(b) by 132 days.

This patent is subject to a terminal disclaimer.

(21) Appl. No.: 18/348,029

(22) Filed: Jul. 6, 2023

(65) Prior Publication Data

US 2023/0349656 A1 Nov. 2, 2023

Related U.S. Application Data

(63) Continuation of application No. 17/336,838, filed on Jun. 2, 2021, now Pat. No. 11,740,045, which is a continuation of application No. 16/423,790, filed on May 28, 2019, now Pat. No. 11,079,193.

(60) Provisional application No. 62/678,145, filed on May 30, 2018.

(51) Int. Cl.
*F41A 17/46* (2006.01)

(52) U.S. Cl.
CPC ..... *F41A 17/46* (2013.01)

(58) Field of Classification Search
CPC ..... F41A 17/46; F41A 17/54; F41A 17/02; F41A 17/20; F41A 17/52
USPC ..... 42/70.06
See application file for complete search history.

(56) References Cited

U.S. PATENT DOCUMENTS

| | | | |
|---|---|---|---|
| 5,355,768 | A | 10/1994 | Felk |
| 6,212,812 | B1 | 4/2001 | Aigner |
| 11,079,193 | B1 | 8/2021 | Niswander et al. |
| 2010/0269391 | A1 | 10/2010 | Doll et al. |
| 2011/0072705 | A1 | 3/2011 | Simpkins |
| 2014/0366419 | A1 | 12/2014 | Allan |
| 2015/0330734 | A1 | 11/2015 | Kolev et al. |
| 2017/0108304 | A1 | 4/2017 | Heizer |
| 2017/0268843 | A1 | 9/2017 | Heizer |
| 2019/0128630 | A1 | 5/2019 | Geissele |
| 2019/0195588 | A1 | 6/2019 | Lake |
| 2021/0341242 | A1 | 11/2021 | Niswander et al. |

*Primary Examiner* — Michael D David
(74) *Attorney, Agent, or Firm* — Eversheds Sutherland (US) LLP

(57) ABSTRACT

A firearm safety mechanism assembly is provided. The firearm safety mechanism assembly includes a firearm with a receiver, a trigger guard coupled to the firearm, and a housing pin. The firearm safety mechanism assembly includes a trigger safety mechanism. The trigger safety mechanism includes a plate, a rod extending from the plate, a trigger coupled to the rod, and a lever nested within the trigger. The lever includes a lever first end and a lever second end, where the lever rotates between a first position and a second position. In the first position, the lever first end abuts a housing pin.

20 Claims, 6 Drawing Sheets

TRIGGER SAFETY WITH ROTATABLE LEVER

CROSS-REFERENCE TO RELATED APPLICATIONS

The disclosure claims priority to, the benefit of, and is a continuation application of U.S. application Ser. No. 17/336,838, filed Jun. 2, 2021, which claims priority to, the benefit of, and is a continuation application of U.S. application Ser. No. 16/423,790, filed May 28, 2019, which claims priority to and the benefit of U.S. Provisional Application No. 62/678,145, filed May 30, 2018, which are all incorporated by reference herein in their entireties.

TECHNICAL FIELD

The present application relates generally to firearm trigger safety mechanisms.

BACKGROUND

Firearm safety mechanisms have been an integral and important part of modern firearms. Firearm safety mechanisms prevent the unintentional discharge of a firearm. Typical firearm safety mechanisms include a manual safety, grip safety, drop safety, or some other apparatus configured to prevent a firearm from discharging a projectile. A trigger safety is one example of a firearm safety mechanism. Generally, the trigger safety uses a lever component to prevent the firing pin and the trigger bar from moving in coordination with a trigger pull unless the lever component is also pulled. Traditional trigger safety mechanisms use the firearm's exterior body to prevent accidental discharge. However, using the exterior body to prevent accidental discharges can be unsightly and potentially dangerous if the exterior body is damaged.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

The present disclosure provides for a firearm safety mechanism assembly, which includes a firearm and a trigger safety mechanism. The trigger safety mechanism is disposed within the firearm and adapted to prevent rotation of a trigger without actuation of a lever nested within the trigger. For example, the firearm internals (e.g., receiver) can include a housing pin rigidly placed within the firearm. The lever nested within the trigger can rotate between a first position and a second position. In the first position, the lever abuts the housing pin thereby preventing rotation of the trigger. As the lever actuates to a second position, the trigger can rotate to discharge a firearm. One benefit of the trigger safety mechanism is to provide an extra layer of safety to the firearm but still allow for quick discharge of the firearm.

The disclosure now will be described more fully hereinafter with reference to the accompanying drawings, in which exemplary embodiments are shown. The concepts discussed herein may, however, be embodied in many different forms and should not be construed as limited to the examples set forth herein; rather, these examples are provided so that this disclosure will be thorough and complete, and will fully convey the scope to those of ordinary skill in the art. Like numbers refer to like, but not necessarily the same or identical, elements throughout.

Figure 1:
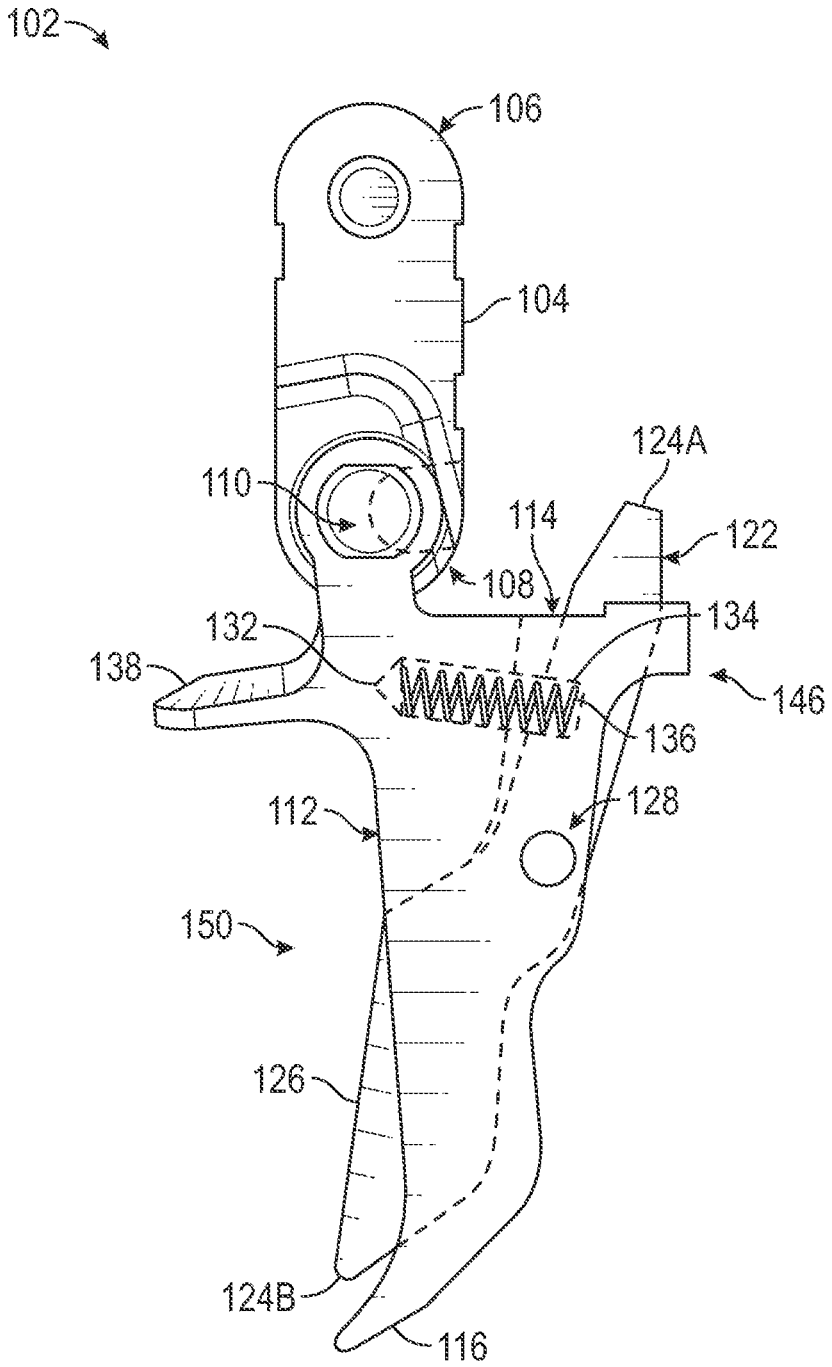
FIG. 1 is a side view of a trigger safety mechanism according to one or more embodiments of the disclosure.
Figure 2:
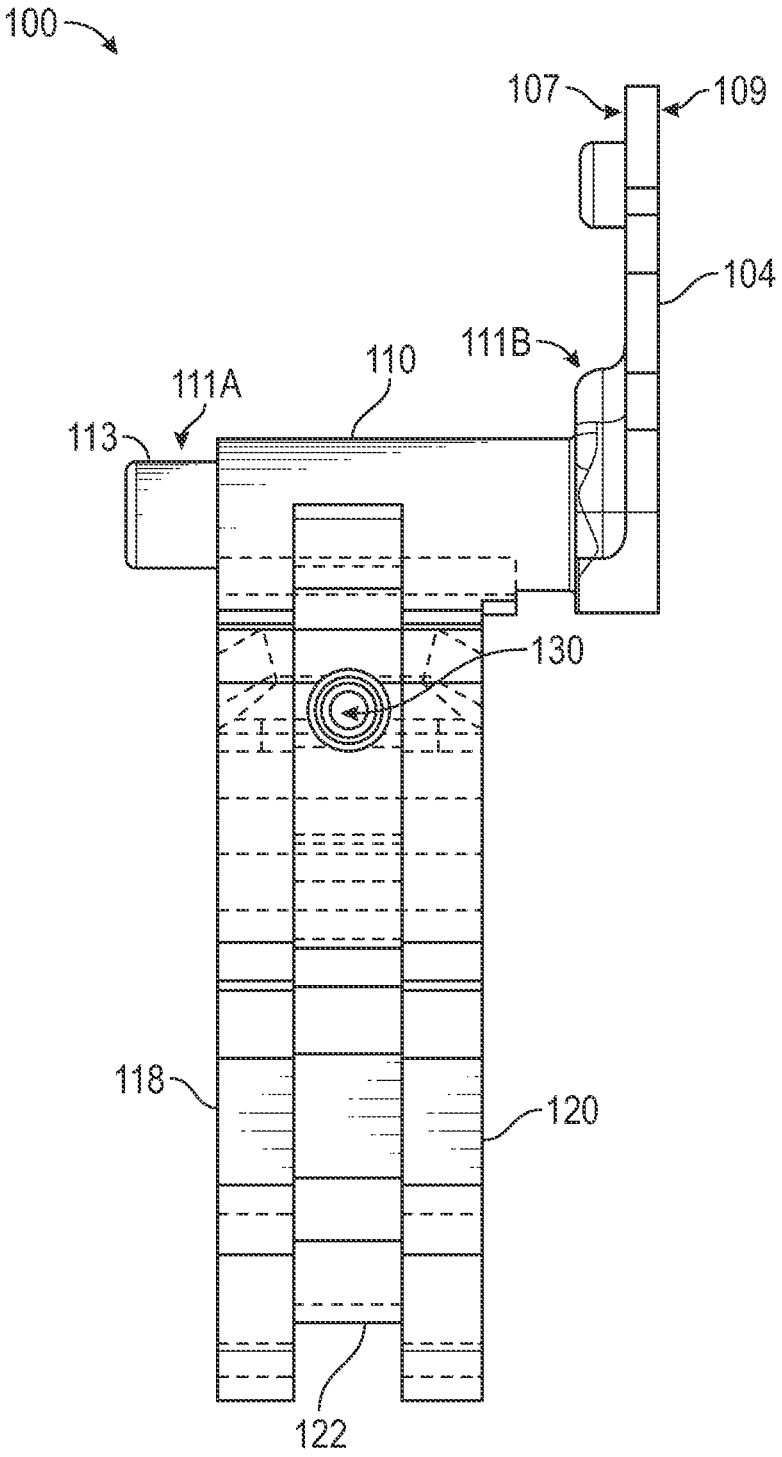
FIG. 2 is a rear view of the trigger safety mechanism according to one or more embodiments of the disclosure.
Figure 3:
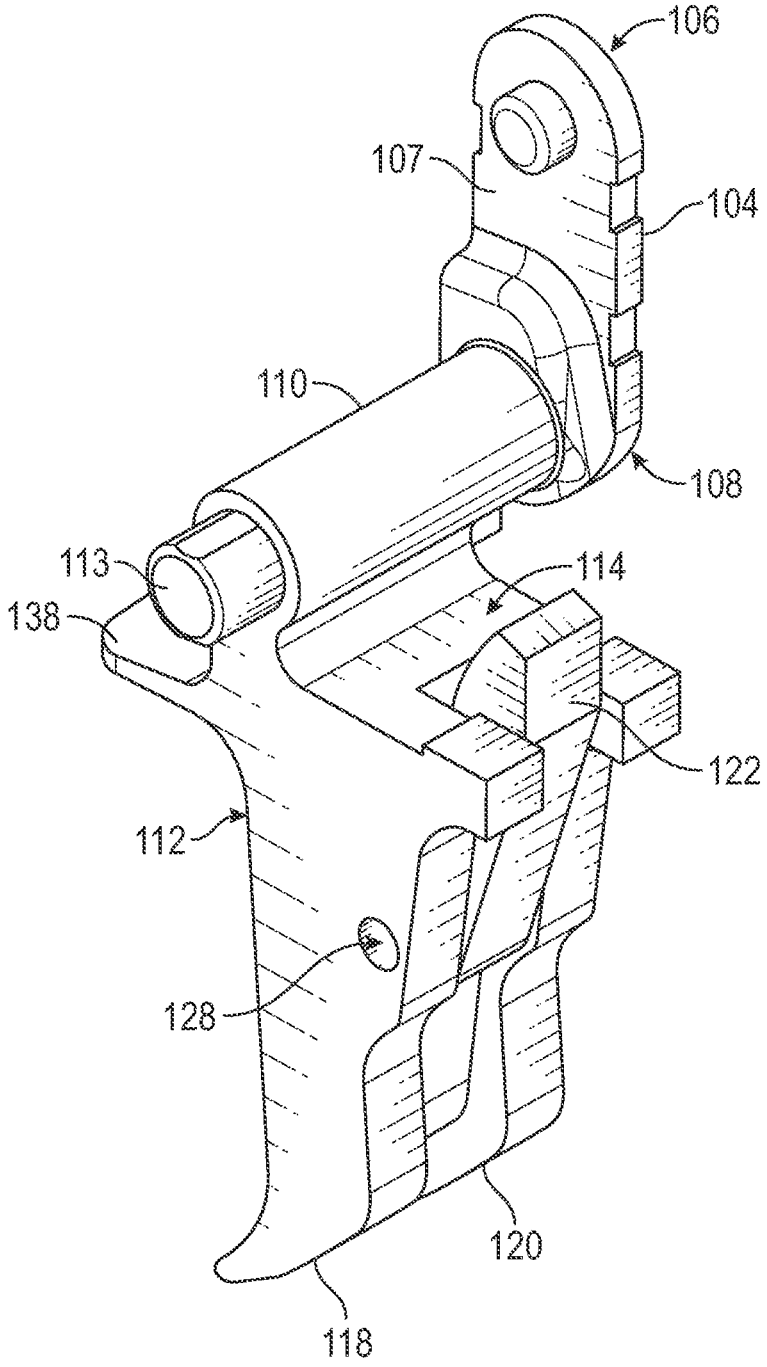
FIG. 3 is a top rear perspective view of the trigger safety mechanism according to one or more embodiments of the disclosure.
Figure 4:
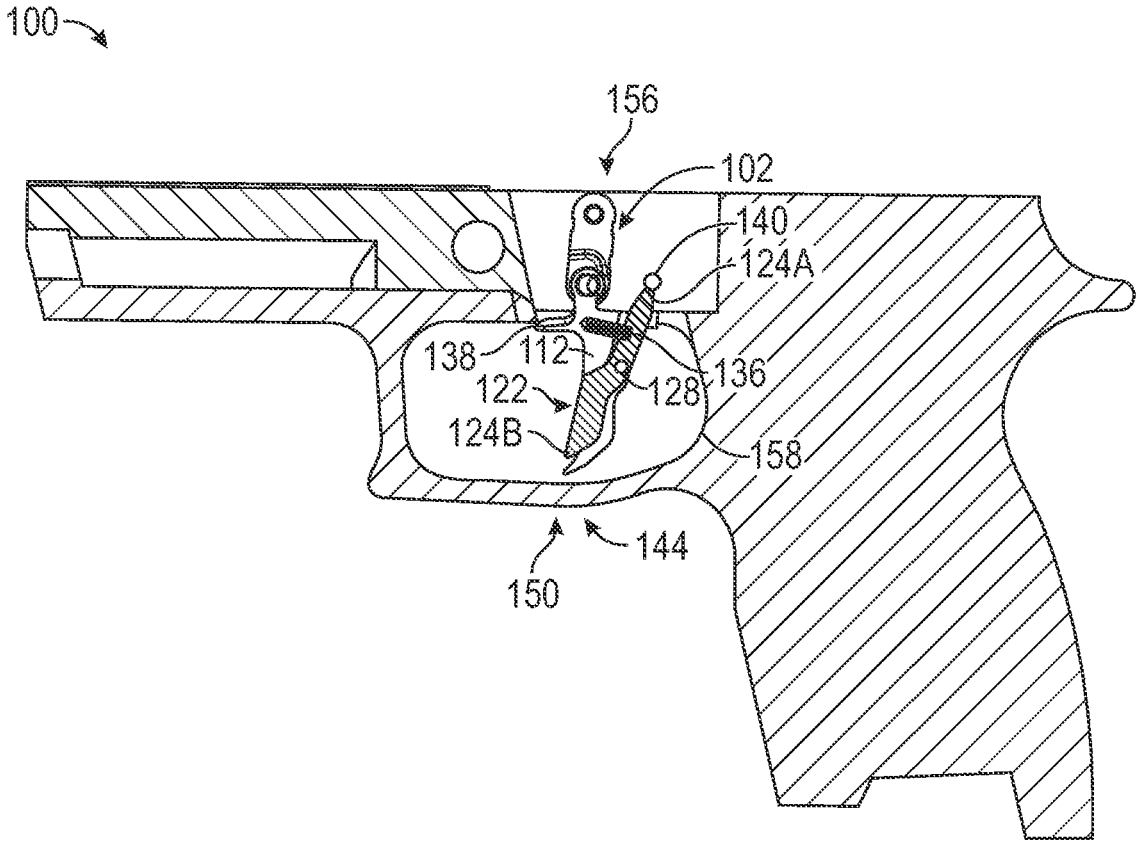
FIG. 4 is a side view of a firearm safety mechanism assembly in a released position according to one or more embodiments of the disclosure.

FIG. 1 is a side view of a trigger safety mechanism in a disengaged position according to one or more embodiments of the disclosure. FIG. 2 is a rear view of the trigger safety mechanism according to one or more embodiments of the disclosure. FIG. 3 is a top rear perspective view of the trigger safety mechanism according to one or more embodiments of the disclosure. Referring to FIGS. 1-3, the trigger safety mechanism 102 includes a plate 104 extending from a plate first end 106 to a plate second end 108. The plate 104 can be pill-shaped, placed within a firearm 154 (e.g., as shown in FIG. 4), and configured to rotate clockwise and counterclockwise. The plate 104 may be any geometric shape (e.g., circular, rectangular, triangular). The plate 104 can attach to a trigger bar within a firearm. That is, the plate 104 can actuate to discharge the firearm 154. Approximate to the plate second end 108 is a rod 110 extending therefrom. For example, the rod 110 can include a fore end 111A and an aft end 111B. The aft end 111B of the rod is coupled to the plate 104. The fore end 111A can include a boss 113 configured to rest within a complementary aperture (not shown) within the firearm receiver 156 (e.g., as shown in FIG. 4) about which the rod 110 rotates. The fore end 111A of the rod 110 can be disposed on a first face 107 of the plate 104. The rod 110 may be disposed through the plate or on the second face 109 of the plate 104.

Referring to FIGS. 1-3, the trigger safety mechanism 102 includes a trigger 112 coupled to the rod 110. In one example, the trigger 112 includes a trigger top end 114 and a trigger bottom end 116. The trigger top end 114 is coupled to the rod 110 along a least a portion of its length. The trigger bottom end 116 can be freely disposed within the trigger guard 158 (e.g., as shown in FIG. 4). Between the trigger top end 114 and the trigger bottom end 116 can be a set of trigger arms (e.g., a trigger first arm 118 and a trigger second arm 120). For example, the trigger first arm 118 can be disposed adjacent to the fore end 111A of the rod 110, and the trigger second arm 120 can be disposed adjacent to the aft end 111B of the rod 110. Each trigger arm can be substantially flat along one surface of the trigger and angled along the other surface. In other examples, the trigger arms can be arcuate or some other shape. In one example, a wedge 138 can extend from one side of the trigger 112, adjacent to the trigger top end 114. The wedge 138 can be a substantially rectangular shape configured to abut the firearm 154 to prevent rotation. That is, the wedge 138 can rest against a firearm surface within the trigger guard 158 when the trigger 112 is in the released position 144.

The trigger safety mechanism 102 can include a lever 122 nested within the trigger 112. In some examples, the lever 122 is anchored within the trigger 112 about a joint 128. That is, the lever 122 can rotate about the joint 128. Referring to FIGS. 1-3, the joint 128 is disposed between the trigger top end 114 and the trigger bottom end 116 as well as between the trigger first arm 118 and the trigger second arm 120. The joint 128 can be a pin joint. In other examples, the joint 128 may be a ball joint, pivot joint, or hinge joint. The lever 122 can include a lever first end 124A and a lever second end 124B. The joint 128 is located between the lever first end 124A and the lever second end 124B.

Adjacent to the joint 128, a channel 130 extends between the trigger 112 and the lever 122. In one example, a channel first portion 132 is disposed within the trigger 112 and a channel second portion 134 is disposed in the lever 122. The channel first portion 132 and the channel second portion 134 can align when the trigger 112 and the lever 122 are secured about the joint 128. A biasing member 136 can be disposed within the channel 130. In this manner, the biasing member 136 can be a compression spring configured to actuate the lever 122 and the trigger 112 in opposing rotational directions. That is, the biasing member 136 can actuate between a resting position 146 and a compressed position 148. In some examples, when the lever second end 124B is rotated in a counterclockwise direction toward the trigger bottom end 116, the biasing member 136 is placed into a compressed position. When the lever 122 is released, the biasing member 136 can extend to the resting position thereby pushing the lever 122 in the clockwise direction. The trigger 112, the lever 122, and the biasing member 136 may rotate clockwise or counterclockwise directions. The biasing member 136 may be a compression spring, tension spring, extension spring, torsion spring, or some other type of spring. When a force does not act on the lever 122, the lever 122 may be biased to rotate in a clockwise motion back to a first position 150 via the biasing member 136.

Figure 5:
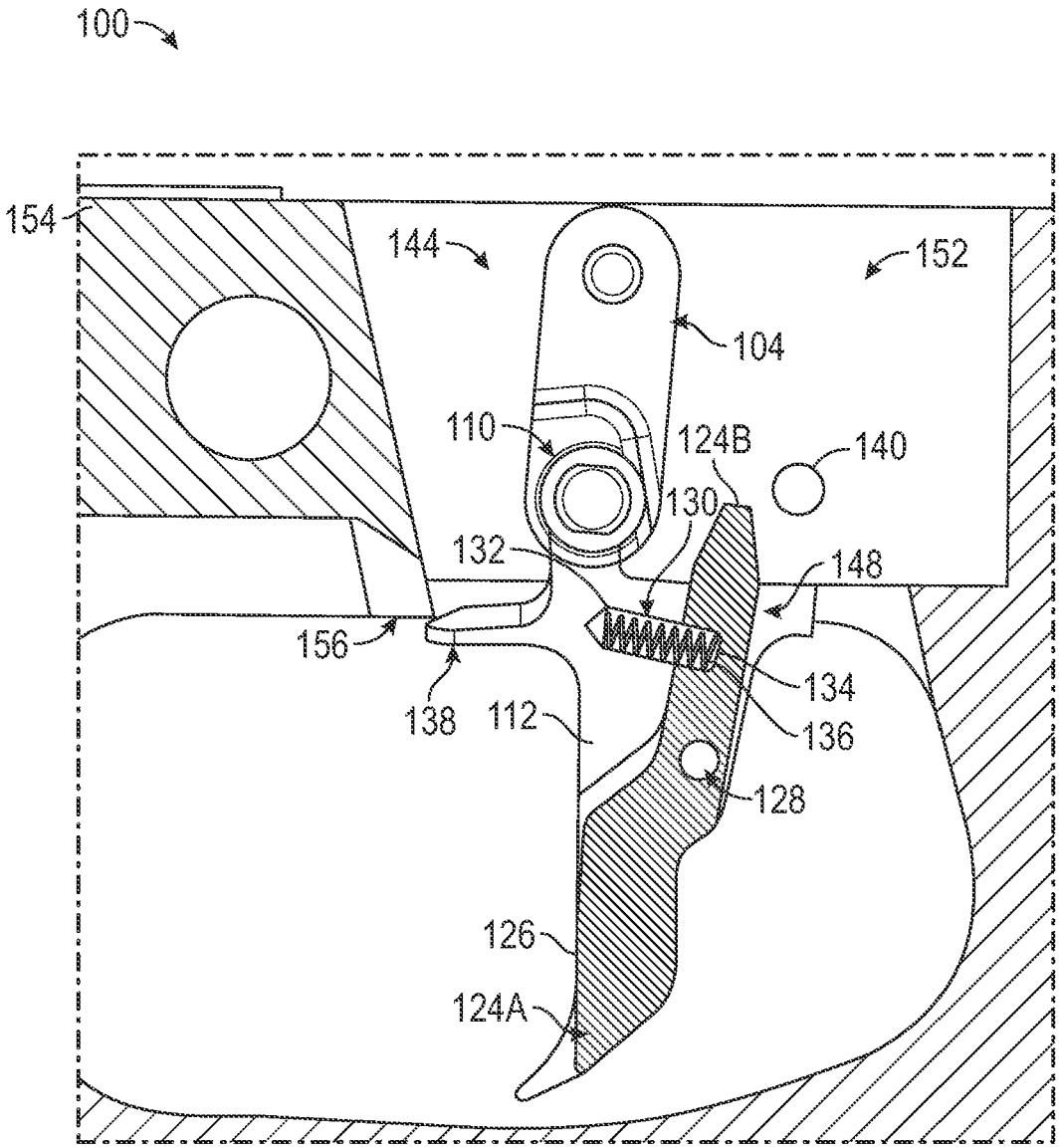
FIG. 5 is a magnified side view of a lever in the firearm safety mechanism assembly in a second position according to one or more embodiments of the disclosure.
Figure 6:
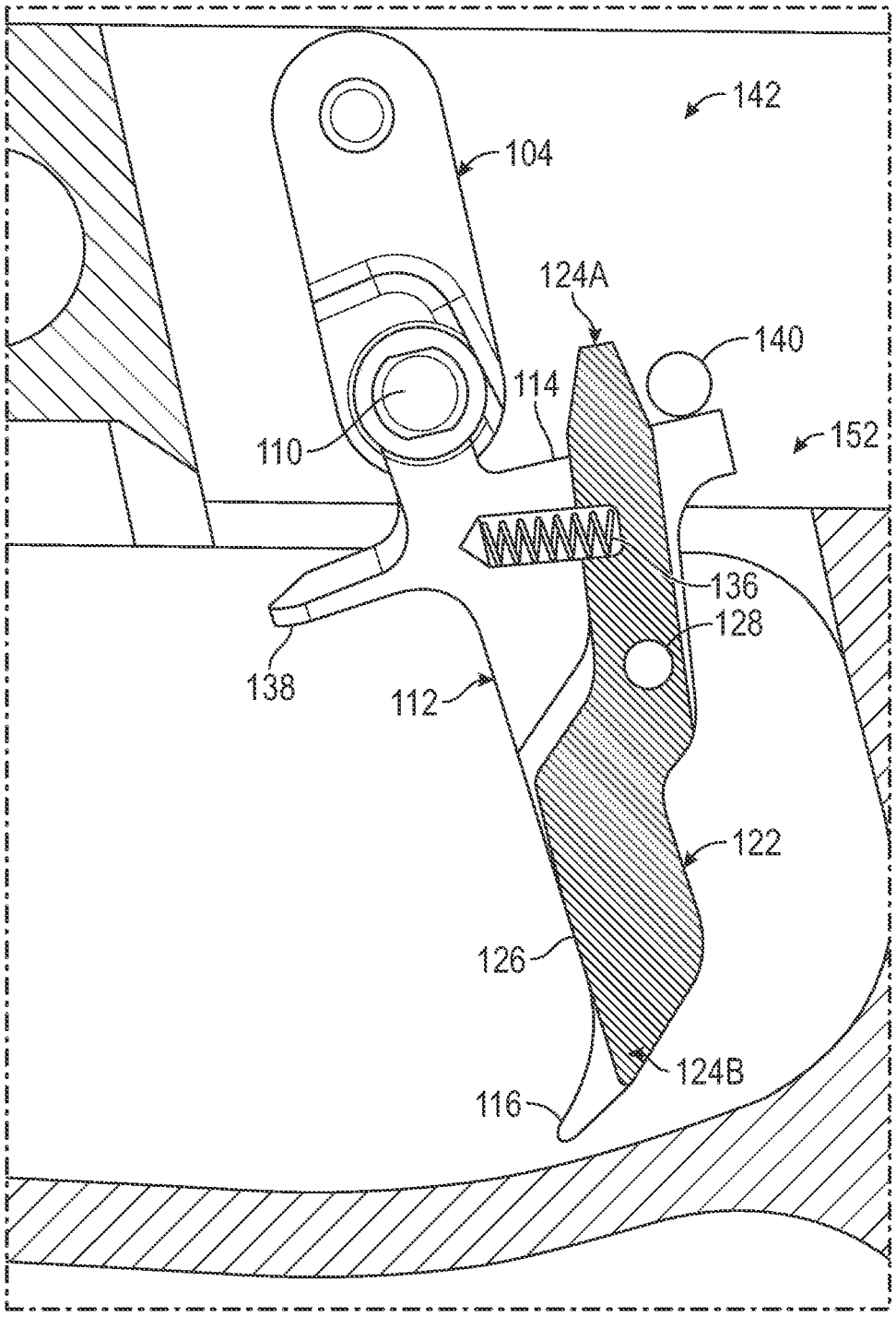
FIG. 6 is a magnified side view of a trigger in the firearm safety mechanism assembly in a trigger pull position according to one or more embodiments of the disclosure.

Referring to FIGS. 4-6, the firearm safety mechanism assembly 100 is shown actuating between a safety position (e.g., as shown in FIG. 4) and a discharging position (e.g., as shown in FIG. 6). As shown in FIG. 4, the lever 122 is in the first position 150. In the first position 150, the lever 122 rests actuated where the lever first end 124A abuts a housing pin 140 and the lever second end 124B is not aligned with the trigger bottom end 116. In some examples, the housing pin 140 can be a cylindrical boss disposed within the firearm 154. In other examples, the housing pin 140 may be a hook, c-shaped, rectangular, square, or some other shape. The lever 122 may have a complementary shape to the housing pin 140 to engage the housing pin 140 when the lever 122 is not rotated within the trigger 112. In this manner, the lever second end 124B abutting the housing pin 140 prevents rotation of the trigger 112 from the released position 144 to a trigger pull position 142. FIG. 4 depicts the trigger 112 in the released position 144. In the first position 150, the biasing member 136 is in the resting position 146. The wedge 138 abuts the firearm 154 in the released position 144.

FIG. 5 depicts the lever 122 in the second position 152. In some examples, a user applies a force to the lever first surface 126 thereby rotating the lever about the joint 128. The lever first surface 126 can sit flush with the trigger 112 surface and the lever 122 can be substantially disposed between the trigger first arm 118 and the trigger second arm 120. In other examples, the lever 122 can provide textile feedback and not sit flush within the trigger 112. In the second position 152, the lever second end 124B rotates between the trigger first arm 118 and the trigger second arm 120. The lever first end 124A rotates away from the housing pin 140. As the lever 122 rotates to the second position 152 the biasing member 136 actuates to the compressed position 148 within the channel 130.

FIG. 5 depicts the lever 122 in the second position, the biasing member 136 in the compressed position 148, and the trigger 112 in the trigger pull position 142. In this manner, the trigger 112 is configured to discharge the firearm 154. In some examples, the trigger top end 114 rotates to abut the housing pin 140. In other examples, the trigger top end 114 does not contact the housing pin 140 upon rotation. The trigger 112 is capable of rotation by the lever first end 124A not abutting the housing pin 140. The wedge 138 rotates in the same direction as the trigger 112. One benefit of rotating the lever 122 simultaneously with the trigger 112 is to allow for ease of use as well as promote safety.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A trigger safety mechanism, comprising:

a plate with a plate first end and a plate second end;

a rod extending from the plate second end;

a trigger directly coupled to the rod, and rotatable about the rod; and a lever comprising a lever first end and a lever second end, wherein the lever is nested within the trigger and rotatable about a joint anchored in the trigger, wherein the lever rotates between a first position and a second position.

2. The trigger safety mechanism of claim 1, further comprising a channel extending between the lever and the trigger.

3. The trigger safety mechanism of claim 2, further comprising a biasing member disposed within the channel.

4. The trigger safety mechanism of claim 3, wherein the biasing member comprises a resting position and a compressed position.

5. The trigger safety mechanism of claim 4, wherein the lever is configured to stop trigger rotation when the biasing member is in the resting position.

6. The trigger safety mechanism of claim 2, wherein the channel further comprising:

a channel first portion within the trigger; and a channel second portion within the lever.

7. The trigger safety mechanism of claim 1, further comprising a wedge extending from the trigger.

8. The trigger safety mechanism of claim 1, wherein the plate first end is coupled to a trigger bar.

9. A firearm safety mechanism assembly, comprising:

a firearm comprising a receiver, and a trigger guard coupled to the firearm adjacent to the receiver;

a trigger safety mechanism comprising a plate, a rod extending from the plate, a trigger directly coupled to the rod, and rotatable about the rod, and a lever nested within the trigger with a lever first end and a lever second end, wherein the lever rotates between a first position and a second position.

10. The firearm safety mechanism assembly of claim 9, further comprising:

a channel first portion disposed within the trigger;

a channel second portion disposed within the lever; and a biasing member disposed between the channel first portion and the channel second portion, wherein the biasing member actuates between a resting position and a compressed position.

11. The firearm safety mechanism assembly of claim 10, wherein as the biasing member actuates to the resting position, the lever actuates to the first position.

12. The firearm safety mechanism assembly of claim 9, further comprising a joint disposed through the lever and the trigger about which the lever rotates.

13. The firearm safety mechanism assembly of claim 9, further comprising a wedge extending from the trigger.

14. The firearm safety mechanism assembly of claim 13, further comprising:

a trigger pull position; and a trigger released position, wherein the wedge abuts the receiver in the trigger released position.

15. A firearm safety mechanism assembly, comprising:

a firearm comprising a receiver, and a trigger guard coupled to the firearm adjacent to the receiver;

a trigger safety mechanism comprising a trigger directly coupled to a rod and rotatable about the rod when actuated, the trigger comprising a trigger first arm and a trigger second arm, a wedge extending from the trigger, and a lever nested between the trigger first arm and the trigger second arm, wherein the lever rotates about a joint anchoring the lever within the trigger, wherein the lever actuates between a first position and a second position.

16. The firearm safety mechanism assembly of claim 15, further comprising:

a channel first portion disposed within the trigger; and a channel second portion disposed within the lever.

17. The firearm safety mechanism assembly of claim 16, further comprising a biasing member disposed between the channel first portion and the channel second portion, wherein the biasing member actuates between a resting position and a compressed position.

18. The firearm safety mechanism assembly of claim 17, wherein the biasing member is configured to separate the channel first portion and the channel second portion.

19. The firearm safety mechanism assembly of claim 15, wherein the lever comprising a first end and a second end, wherein the first end of the lever abuts the housing pin in the first position and prevents rotation of the trigger.

20. The firearm safety mechanism assembly of claim 15, further comprising:

a trigger pull position, wherein the trigger is rotated within the trigger guard; and a trigger released position, wherein the wedge abuts the receiver in the trigger released position.

* * * * *